US010099836B2

(12) United States Patent
Cheich

(10) Patent No.: US 10,099,836 B2
(45) Date of Patent: Oct. 16, 2018

(54) THERMAL INSULATION DUNNAGE AND METHOD

(71) Applicant: Ranpak Corp., Concord Township, OH (US)

(72) Inventor: Robert C Cheich, Independence, OH (US)

(73) Assignee: RANPAK CORP., Concord Township, OH (US)

( * ) Notice: Subject to any disclaimer, the term of this patent is extended or adjusted under 35 U.S.C. 154(b) by 440 days.

(21) Appl. No.: 14/777,274

(22) PCT Filed: Mar. 14, 2014

(86) PCT No.: PCT/US2014/028838
§ 371 (c)(1),
(2) Date: Sep. 15, 2015

(87) PCT Pub. No.: WO2014/144428
PCT Pub. Date: Sep. 18, 2014

(65) Prior Publication Data

US 2016/0023831 A1 Jan. 28, 2016

Related U.S. Application Data

(60) Provisional application No. 61/786,666, filed on Mar. 15, 2013.

(51) Int. Cl.
*B65D 81/03* (2006.01)
*B65D 81/05* (2006.01)
(Continued)

(52) U.S. Cl.
CPC ..... *B65D 81/052* (2013.01); *B31D 5/006* (2013.01); *B31D 5/0043* (2013.01);
(Continued)

(58) Field of Classification Search
CPC ..... B65D 81/03; B65D 31/04; B65D 5/00; B65D 81/052; B31D 5/0043; B31D 5/006; B31D 5/0073
(Continued)

(56) References Cited

U.S. PATENT DOCUMENTS 5,912,058 A * 6/1999 Takahashi ..... B32B 27/10 428/34.3
2005/0013974 A1* 1/2005 Koyanagi ..... B31D 5/0073 428/178

FOREIGN PATENT DOCUMENTS

WO 96/24540 A1 8/1996
WO WO 9624540 8/1996

OTHER PUBLICATIONS

International Preliminary Report of Patentability for PCT/US2014/028838, filed Mar. 14, 2014.
International Search Report for PCT/US2014/028838.

* cited by examiner

*Primary Examiner* — King M Chu
(74) *Attorney, Agent, or Firm* — Renner, Otto, Boisselle & Sklar, LLP

(57) ABSTRACT

A method for making an insulating dunnage product (10) includes the steps of (a) permanently deforming at least one non-planar interior layer (12) that includes a paper sheet to form a plurality of air pockets (14), (b) surrounding the at least one interior layer (12) on all four sides and over the top and bottom sides of the at least one interior layer (12) with at least one outer layer (16) of sheet material and (c) peripherally sealing the at least one outer layer (16) to capture the at least one interior layer (12) therein such that the interior layer (12) has major portions that are free to shift relative to adjacent portions of the at least one outer layer (16).

10 Claims, 5 Drawing Sheets

(51) Int. Cl.
*B31D 5/00* (2017.01)
*B65B 63/08* (2006.01)

(52) U.S. Cl.
CPC ..... *B31D 5/0073* (2013.01); *B65B 63/08* (2013.01); *B65D 81/051* (2013.01)

(58) Field of Classification Search
USPC ..... 206/433, 522
See application file for complete search history.

THERMAL INSULATION DUNNAGE AND METHOD

RELATED APPLICATIONS

This application is a national phase of International Application No. PCT/US2014/028838 filed Mar. 13, 2014, and published in the English language, and which claims the benefit of U.S. Provisional Application No. 61/786,666 filed Mar. 15, 2013.

FIELD OF THE INVENTION

This invention is generally in the field of protective packaging material or dunnage, and more particularly is concerned with a dunnage product with thermal insulation properties.

BACKGROUND

A common insulated container for refrigerated shipping uses a molded polystyrene liner, commonly referred to as styrofoam, within a cardboard box. An ice pack or other cooling element also is placed in the container to keep the contents of the box cool during shipment. Additional layers of insulation also may be used to separate the contents from direct contact with the cooling element and any moisture that may condense around the cooling element or nearby surfaces.

SUMMARY

Despite functioning well during actual shipment, the current refrigerated shipping system has several problems. For example, the polystyrene liners require a lot of space for storage at and before shipment to the packaging center. Polystyrene also is not readily recyclable, produces hazardous materials when burned, and because it does not readily decompose, it has a persistent presence in the environment. For all of these reasons, such molded plastic containers present disposal problems for the recipients of these shipping containers.

The present invention provides a paper-based insulating dunnage product that has adequate insulation properties to supplant some or all of the applications that currently require refrigerated shipment. Paper is a renewable resource, and can be recycled, composted, or burned with fewer and less hazardous byproducts than polystyrene. More specifically, the present invention provides a dunnage product formed of one or more sheets of paper deformed out of their planar state to form a plurality of air pockets, wrapped within an outer cover. The paper is relatively impermeable to air, and the dunnage products provide cushioning properties and air pockets that provide insulation properties. Moreover, the interior layer of paper can be produced from a relatively compact and more dense supply of stock material, such as a roll or a fan-folded stack of paper. Additionally, such a dunnage product can be produced on demand, as needed. Accordingly, the present invention provides an insulating dunnage product in a much more compact configuration for improved transportation and reduced storage requirements for the packaging center, while providing an insulating material that is more easily disposed of or recycled by the recipient.

An exemplary embodiment of the invention includes an insulating dunnage product that includes at least one non-planar interior layer of a paper sheet permanently deformed to form a plurality of air pockets. The deformed sheet has peripheral edges and top and bottom sides. The insulating dunnage product further includes at least one outer layer of sheet material surrounding the at least one interior layer. The outer layer is peripherally sealed to capture the at least one interior layer therebetween on all four sides and over the top and bottom sides of the at least one interior layer. The at least one interior layer has major portions that are free to shift relative to adjacent portions of the at least one outer layer.

The dunnage product provided by the invention can further include one or more of the following features: the at least one outer layer of sheet material includes paper; the at least one outer layer includes an upper outer layer and a lower outer layer with peripheral portions sealed to bound the at least one interior layer; the at least one outer layer is formed by a single sheet that wraps around one side of the interior layer and is sealed on the periphery of the other three sides of the interior layer; or the dunnage product includes one or more fold lines in the at least one outer layer, where the interior layer includes discontinuous sections separated by the fold lines.

The present invention also provides a method for making an insulating dunnage product. The method includes the steps of (a) permanently deforming at least one non-planar interior layer that includes a paper sheet to form a plurality of air pockets; (b) surrounding the at least one interior layer on all four sides and over the top and bottom sides of the at least one interior layer with at least one outer layer of sheet material; and (c) peripherally sealing the at least one outer layer to capture the at least one interior layer therein such that the interior layer has major portions that are free to shift relative to adjacent portions of the at least one outer layer.

The method provided by the invention can further include one or more of the following features: (i) the deforming step includes converting paper in roll or fan-fold form into a relatively less dense dunnage product; (ii) the surrounding step includes surrounding the at least one interior layer with an outer layer of paper; (iii) the surrounding step includes placing the at least one interior layer two layers of paper; (iv) the surrounding step includes surrounding the at least one interior layer with a sheet material having a cohesive coating; (v) the surrounding step includes surrounding the at least one interior layer with two separate sheets on opposing sides of the at least one interior layer; (vi) further comprising the step of forming fold lines in at least the at least one outer layer; (vii) the forming step includes forming fold lines in the at least one outer layer between portions of the at least one interior layer so as to separate the portions of the at least one interior layer with fold lines; (viii) the forming step includes forming two fold lines to separate three sections of the at least one interior layer; (ix) comprising the step of placing the dunnage product within a container to cover three sides of the container; (x) further comprising the step of repeating the placing step to cover all sides of the container when the container is closed; or (xi) comprising the step of placing the dunnage product in a container, placing a cooling element in the container on the dunnage product, and placing another dunnage product on the cooling element before adding an item to be shipped.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

DETAILED DESCRIPTION

Despite functioning well during actual shipment, the current refrigerated shipping system has several problems. For example, the polystyrene liners require a lot of space for storage at and before shipment to the packaging center. Polystyrene also is not readily recyclable, produces hazardous materials when burned, and because it does not readily decompose, it has a persistent presence in the environment. For all of these reasons, such molded plastic containers present disposal problems for the recipients of these shipping containers.

In recognition of these problems, the present invention provides a paper-based insulating dunnage product that has adequate insulation properties to supplant some or all of the applications that currently require refrigerated shipment. Paper is a renewable resource, and can be recycled, composted, or burned with fewer and less hazardous byproducts than polystyrene. More specifically, the present invention provides a dunnage product formed of one or more sheets of paper deformed out of their planar state to form a plurality of air pockets, wrapped within an outer cover. The paper is relatively impermeable to air, and the dunnage products provide cushioning properties and air pockets that provide insulation properties. Moreover, the interior layer of paper can be produced from a relatively compact and more dense supply of stock material, such as a roll or a fan-folded stack of paper. Additionally, such a dunnage product can be produced on demand, as needed. Accordingly, the present invention provides an insulating dunnage product in a much more compact configuration for improved transportation and reduced storage requirements for the packaging center, while providing an insulating material that is more easily disposed of or recycled by the recipient.

Figure 1:
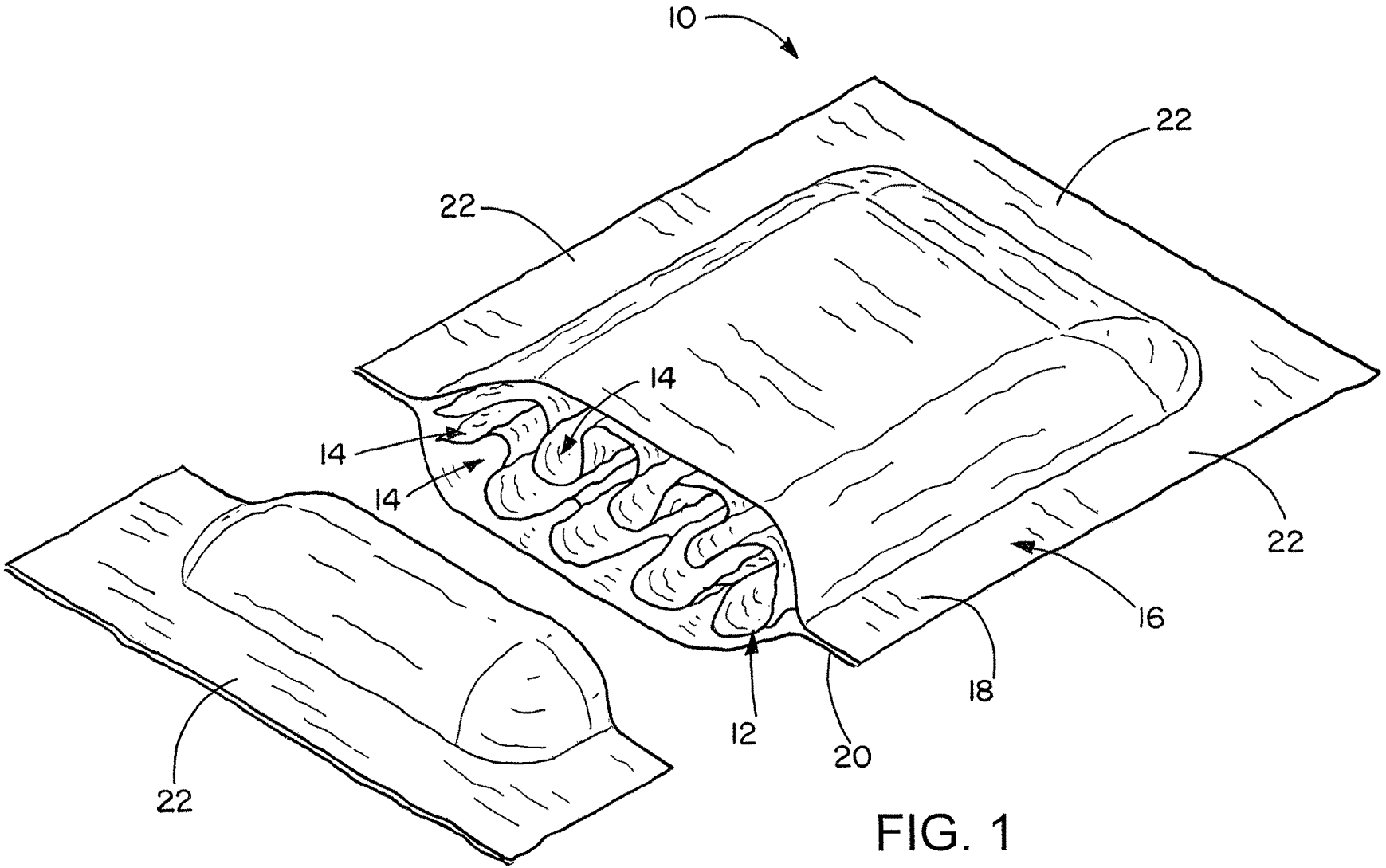
FIG. 1 is a schematic illustration of an insulating dunnage product provided by the invention.

Referring now to the drawings in detail, an insulating dunnage product 10 provided by the invention is shown in FIG. 1 cut open to show its interior. The dunnage product 10 includes at least one non-planar interior layer 12 of a paper sheet permanently deformed to form a plurality of air pockets 14. Kraft paper is an exemplary paper for the interior layer 12. The deformed sheet that forms the interior layer 12 has peripheral edges and top and bottom sides.

An exemplary interior layer is a crumpled or otherwise permanently deformed sheet of paper, such as that produced by a dunnage conversion machine that converts paper in roll or fan-fold form into a relatively less dense dunnage product that can be enclosed within outer layers. The interior layer can take the form of a cushioning pad, such as is shown in U.S. Pat. No. 5,807,229, or an otherwise permanently deformed sheet, such as is shown in U.S. Pat. No. 7,955,245 or U.S. Pat. No. 5,667,871. Each of these forms of interior layer defines a plurality of air pockets in the crumpled folds or deformations. The dunnage product 10 shown in FIG. 1 includes interior layers 12 formed of two sheets of paper.

The insulating dunnage product 10 further includes at least one outer layer 16 of sheet material surrounding the at least one interior layer 12. The outer layer or layers 16 are peripherally sealed to capture the interior layer or layers 12 therebetween. The dunnage product 10 shown in FIG. 1 has two outer layers, a top outer layer 18 and a bottom outer layer 20. The outer layers 16 capture the interior layers 12 on all four sides of the interior layers 12, including covering the top and bottom sides of the interior layers 12. The outer layers 16 are sealed along the periphery 22 to bound the interior layers 12. Any sealing means may be used, including a cohesive coating on facing surfaces of the outer layers, an adhesive in peripheral portions of the outer layers, or a mechanical connection between the outer layers 16. Regardless of how the outer layers 16 are sealed, however, the interior layers 12 generally are not attached to the outer layers 16. As a result, the interior layers 12 have major portions that are free to shift relative to adjacent portions of the outer layers 16.

Figure 2:
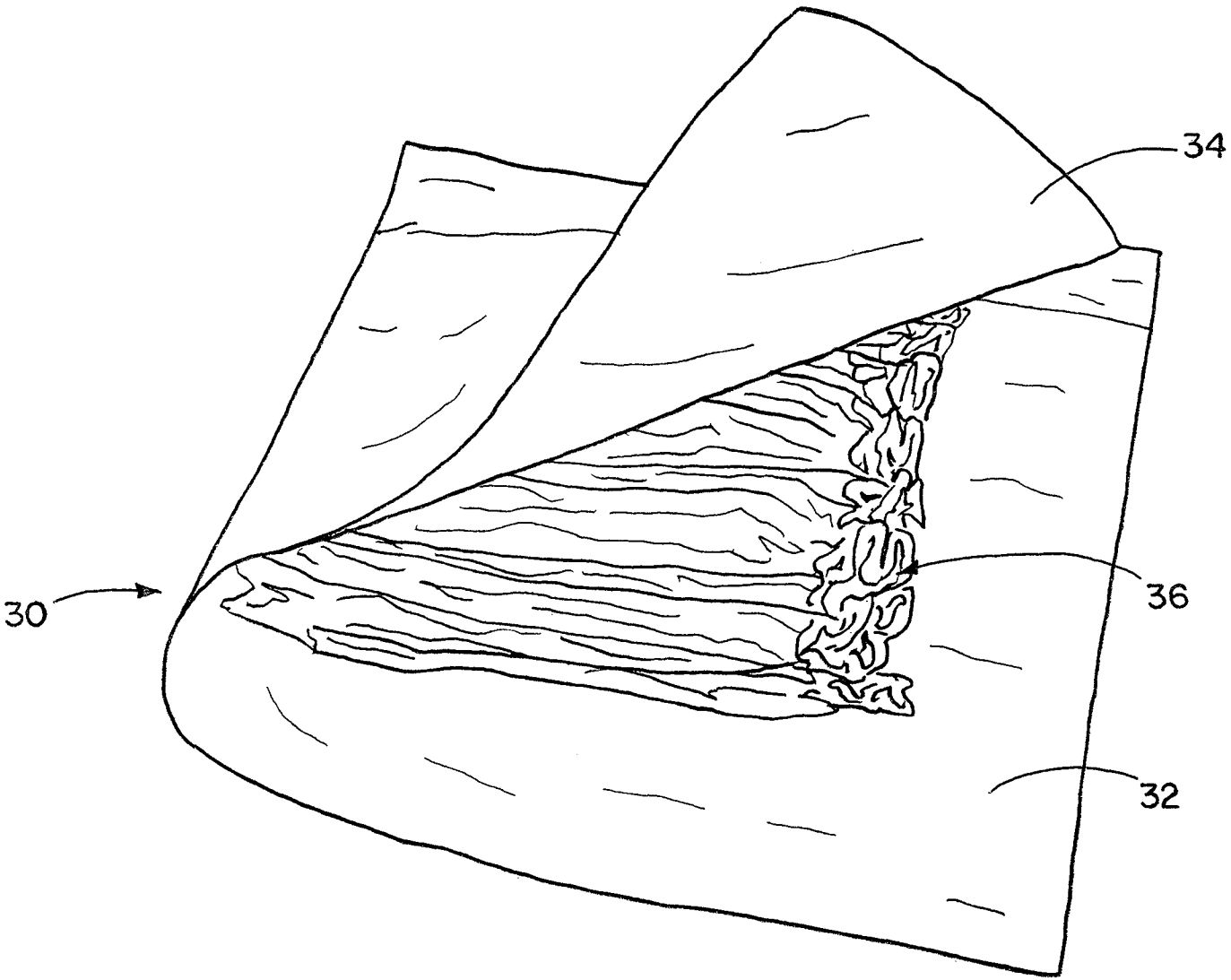
FIG. 2 is a perspective view of an exemplary insulating dunnage product.
Figure 3:
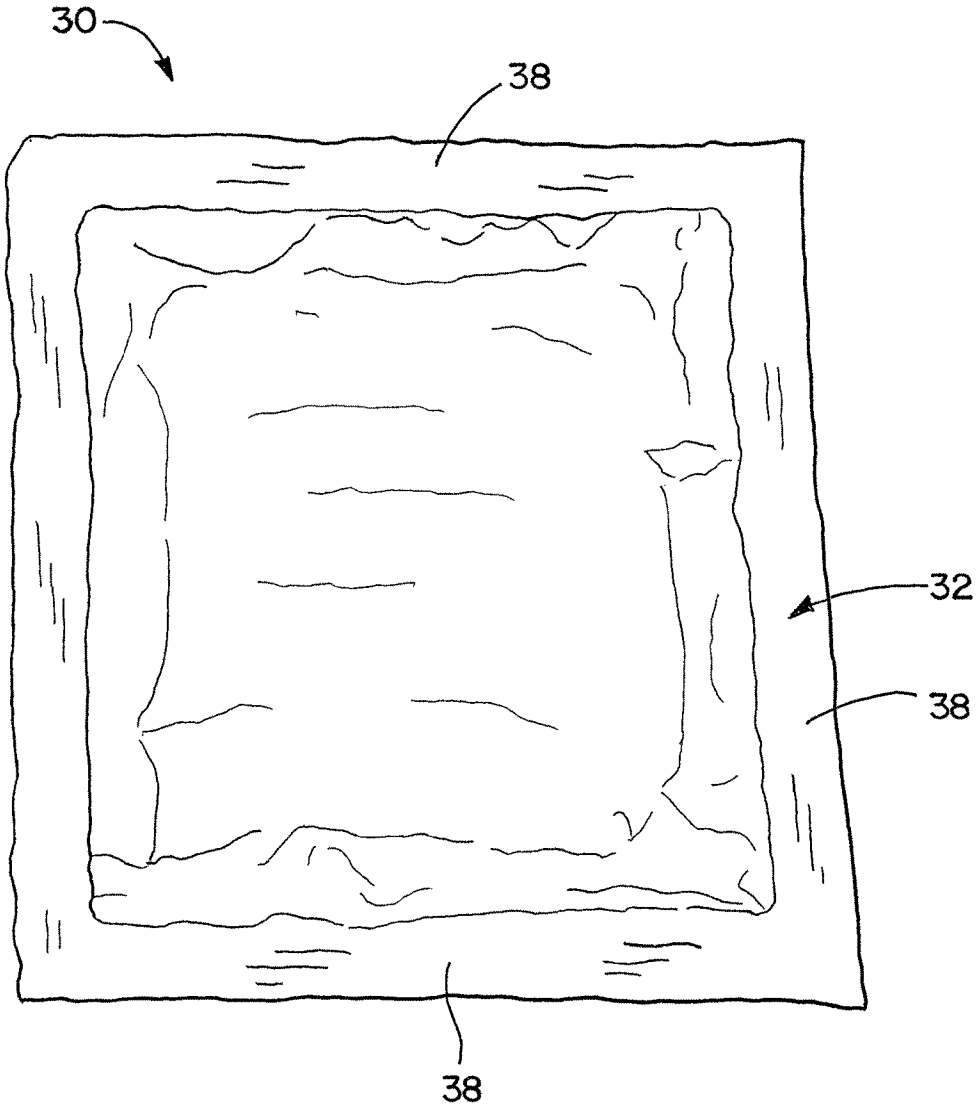
FIG. 3 is a perspective view of another exemplary insulating dunnage product.

While the dunnage product 10 shown in FIG. 1 includes two sheets 18 and 20 that form the outer layers 16, the dunnage product 10 alternatively can use a single sheet to form the outer layers 16. As shown in FIG. 2, the dunnage product 30 includes a single sheet of material that forms top and bottom layers 32 and 34 that wrap around an interior layer 36. On three sides of the interior layer 36 the outer layers 32 and 34 are then sealed to form the dunnage product 30. In the illustrated embodiment, the outer layers 32 and 34 have not yet been sealed, showing the interior layer 36. In this case, the interior layer 36 is a crumpled dunnage product provided in accordance with U.S. Pat. No. 7,955,245. FIG. 3 shows what the insulated dunnage product 30 looks like after peripheral portions 38 of the outer layers 32 have been sealed on three sides.

The dunnage product 30 of FIGS. 2 and 3 is made entirely of paper. Accordingly, both the interior layers 36 are made of paper and the outer layers 32 and 34 include paper. The interior layers 36 provide cushioning and air pockets for insulation, and those air pockets are sealed by the outer layers 32 and 34 to minimize or prevent air migration into and out of the dunnage product 30 to provide insulating properties. The outer layer can be provided in the form of a material or a coating that resists moisture, such as a plastic or a wax, to protect the protective and insulating properties of the interior layers 36 from moisture during the shipping process. To further protect the interior layers 36 from moisture, the outer layers 32 and 34 can be formed by a plastic bag, which can seal out any moisture and prevent any air movement out of the insulating voids provided by the interior layers 36.

Figure 4:
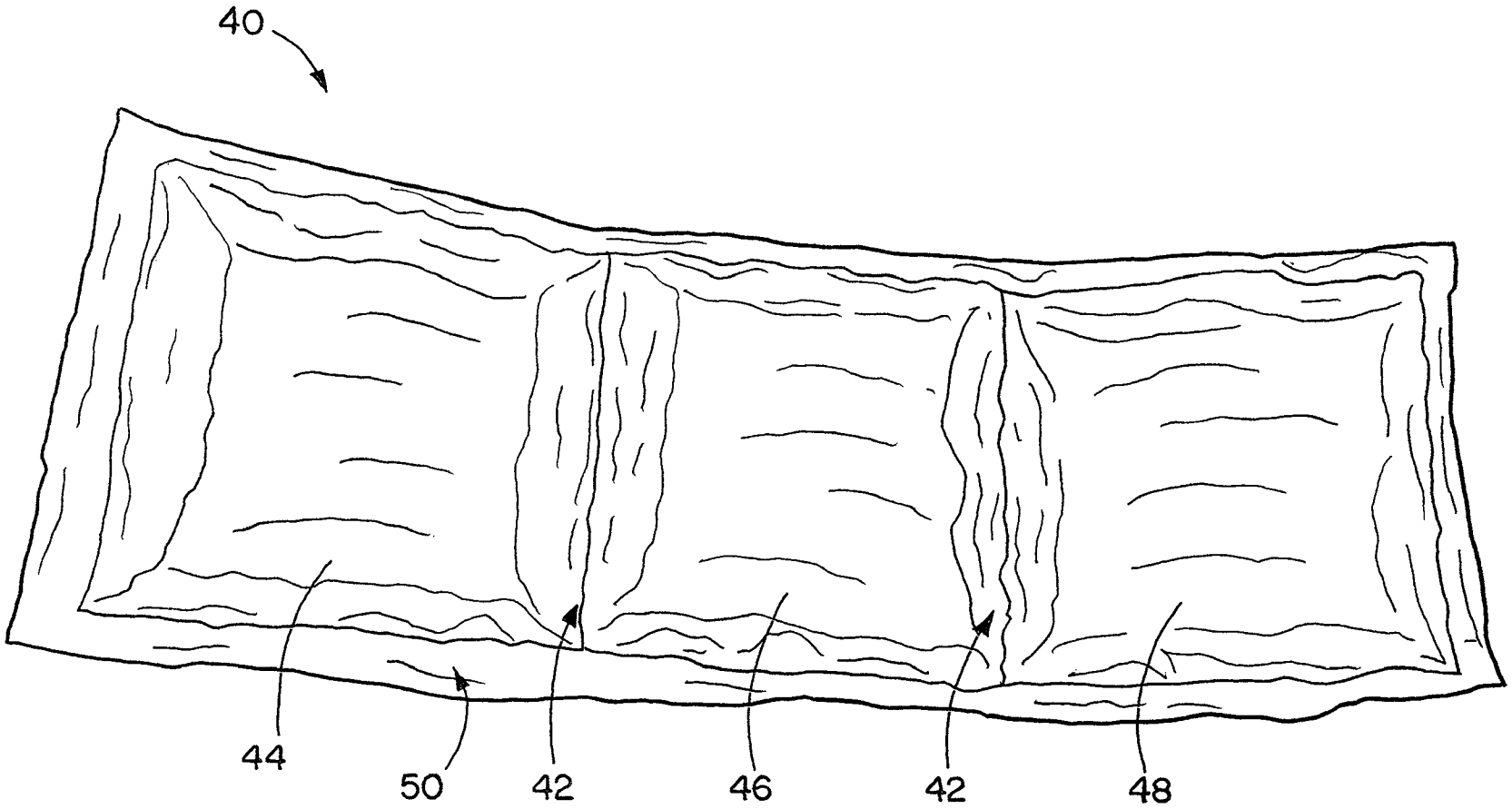
FIG. 4 is a perspective view of an exemplary dunnage product provided by the invention as it is being formed.
Figure 5:
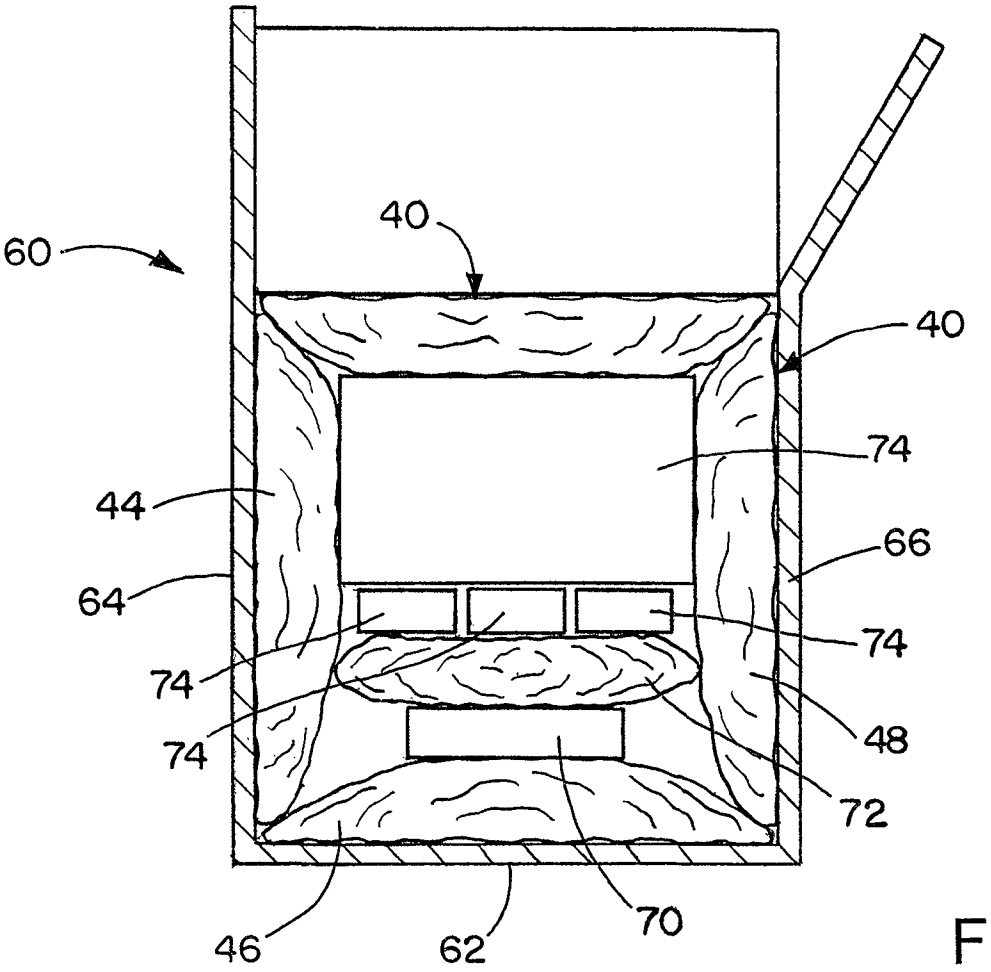
FIG. 5 is a schematic cross-sectional view of a container packaged with the insulating dunnage products provided by the invention.

To facilitate insulating a rectangular cardboard box or other container, the dunnage product 40 can be provided with fold lines 42 at intervals that generally match the dimensions of the container, as shown in FIG. 4. In this example, the interior layer or layers include three discontinuous sections 44, 46, and 48 arranged in a line. Between each section 44, 46, and 48, the outer layers 50 are creased to form fold lines 42 between each of the interior sections 44, 46, and 48. The fold lines 42 allow the dunnage product 40 to be folded into a C-shape, such that the central section 46 will cover one side of a container 60, and the end sections 44 and 48 will cover adjacent sides of the container 60, as shown in FIG. 5. Another three-section dunnage product 40 can be used to insulate the other three sides of the container 60. Accordingly, each section 44, 46, and 48 of the completed dunnage product 40 is sized to closely correspond to corresponding dimensions of the container 60.

In the container 60 shown in FIG. 5, a three-section insulating dunnage product 40 is shown placed in the bottom of the container 60, with a center section 46 adjacent a bottom wall 62 of the container 60, and adjacent sections 44 and 48 extending up opposing side walls 64 and 66, respectively. A cooling element 70 is placed on the center section 46, and a single-section insulating dunnage product 72 is placed on the cooling element 70 to separate items 74 to be shipped from the cooling element 70, and any condensation from the cooling element 70. A further insulating dunnage product or products 40 are placed over the items to be shipped 74 and adjacent the other sides of the container 60 before the container 60 is closed and sealed for shipping.

The present invention also provides a method for making an insulating dunnage product. The method includes the steps of (a) permanently deforming at least one non-planar interior layer that includes a paper sheet, to form a plurality of air pockets; (b) surrounding the at least one interior layer on all four sides and over the top and bottom sides of the at least one interior layer with at least one outer layer of sheet material; and (c) peripherally sealing the at least one outer layer to capture the at least one interior layer therein such that the interior layer has major portions that are free to shift relative to adjacent portions of the at least one outer layer.

The method provided by the invention can further include one or more of the following features: (i) the deforming step includes converting paper in roll or fan-fold form into a relatively less dense dunnage product; (ii) the surrounding step includes surrounding the at least one interior layer with an outer layer of paper; (iii) the surrounding step includes placing the at least one interior layer between two layers of paper; (iv) the surrounding step includes surrounding the at least one interior layer with a sheet material having a cohesive coating; (v) the surrounding step includes surrounding the at least one interior layer with two separate sheets on opposing sides of the at least one interior layer; (vi) further comprising the step of forming fold lines in at least the at least one outer layer; (vii) the forming step includes forming fold lines in the at least one outer layer between portions of the at least one interior layer so as to separate the portions of the at least one interior layer with fold lines; (viii) the forming step includes forming two fold lines to separate three sections of the at least one interior layer; (ix) comprising the step of placing the dunnage product within a container to cover three sides of the container; (x) further comprising the step of repeating the placing step to cover all sides of the container when the container is closed; or (xi) comprising the step of placing the dunnage product in a container, placing a cooling element in the container on the dunnage product, and placing another dunnage product on the cooling element before adding an item to be shipped.

In summary, the present invention provides an insulating dunnage product 10 that includes at least one non-planar interior layer 12 of a paper sheet permanently deformed to form a plurality of air pockets 14. The deformed sheet has peripheral edges and top and bottom sides. The insulating dunnage product 10 further includes at least one outer layer 16 of sheet material surrounding the at least one interior layer 12. The outer layer 16 is peripherally sealed to capture the at least one interior layer 12 therebetween on all four sides and over the top and bottom sides of the at least one interior layer 12. The at least one interior layer 12 has major portions that are free to shift relative to adjacent portions of the at least one outer layer 16.

Although the invention has been shown and described with respect to certain preferred embodiments, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention can have been disclosed with respect to only one of the several embodiments, such feature can be combined with one or more other features of the other embodiments as may be desired and advantageous for any given or particular application.

What is claimed is:

1. A method for making an insulating dunnage product, comprising the following steps:

permanently deforming at least one non-planar interior layer that includes a paper sheet to form a plurality of air pockets;

surrounding the at least one interior layer on all four sides and over the top and bottom sides of the at least one interior layer with at least one outer layer of sheet material; and peripherally sealing the at least one outer layer to capture the at least one interior layer therein such that the interior layer has major portions that are free to shift relative to adjacent portions of the at least one outer layer;

where the surrounding step includes surrounding the at least one interior layer with an outer layer of paper.

2. A method for making an insulating dunnage product, comprising the following steps:

permanently deforming at least one non-planar interior layer that includes a paper sheet to form a plurality of air pockets;

surrounding the at least one interior layer on all four sides and over the top and bottom sides of the at least one interior layer with at least one outer layer of sheet material;

peripherally sealing the at least one outer layer to capture the at least one interior layer therein such that the interior layer has major portions that are free to shift relative to adjacent portions of the at least one outer layer;

where the deforming step includes converting paper in roll or fan-fold form into a relatively less dense dunnage product.

3. A method as set forth in claim 1, where the surrounding step includes placing the at least one interior layer between two layers of paper.

4. A method as set forth in claim 1, where the surrounding step includes surrounding the at least one interior layer with a sheet material having a cohesive coating.

5. A method as set forth in claim 1, where the surrounding step includes surrounding the at least one interior layer with two separate sheets on opposing sides of the at least one interior layer.

6. A method for making an insulating dunnage product, comprising the following steps:

permanently deforming at least one non-planar interior layer that includes a paper sheet to form a plurality of air pockets;

surrounding the at least one interior layer on all four sides and over the top and bottom sides of the at least one interior layer with at least one outer layer of sheet material;

peripherally sealing the at least one outer layer to capture the at least one interior layer therein such that the interior layer has major portions that are free to shift relative to adjacent portions of the at least one outer layer;

where the forming step includes forming fold lines in the at least one outer layer between portions of the at least one interior layer so as to separate the portions of the at least one interior layer with fold lines.

7. A method as set forth in claim 6, where the forming step includes forming two fold lines to separate three sections of the at least one interior layer.

8. A method as set forth in claim 7, comprising the step of placing the dunnage product within a container to cover three sides of the container.

9. A method as set forth in claim 8, further comprising the step of repeating the placing step to cover all sides of the container when the container is closed.

10. A method comprising the following steps:

making a dunnage product by permanently deforming at least one non-planar interior layer that includes a paper sheet to form a plurality of air pockets;

surrounding the at least one interior layer on all four sides and over the top and bottom sides of the at least one interior layer with at least one outer layer of sheet material; and peripherally sealing the at least one outer layer to capture the at least one interior layer therein such that the interior layer has major portions that are free to shift relative to adjacent portions of the at least one outer layer;

placing the dunnage product in a container;

placing a cooling element in the container on the dunnage product; and placing another dunnage product on the cooling element before adding an item to be shipped.

* * * * *